US008783707B2

(12) United States Patent
Reguis et al.

(10) Patent No.: US 8,783,707 B2
(45) Date of Patent: Jul. 22, 2014

(54) BOARD FOR SNOWBOARDING

(75) Inventors: Adrien Reguis, Grenoble (FR); Arnaud Repa, Le Fontanil Cornillon (FR)

(73) Assignee: Skis Rossignol (FR)

( * ) Notice: Subject to any disclaimer, the term of this patent is extended or adjusted under 35 U.S.C. 154(b) by 66 days.

(21) Appl. No.: 12/980,030

(22) Filed: Dec. 28, 2010

(65) Prior Publication Data

US 2011/0175326 A1 Jul. 21, 2011

(30) Foreign Application Priority Data

Jan. 21, 2010 (FR) ..... 10 50406

(51) Int. Cl.
*A63C 5/04* (2006.01)

(52) U.S. Cl.
USPC ..... 280/609; 280/601; 280/14.21; 280/14.22

(58) Field of Classification Search
USPC ..... 280/609, 601, 14.21, 14.22
See application file for complete search history.

(56) References Cited

U.S. PATENT DOCUMENTS

| | | | | |
|---|---|---|---|---|
| 5,667,238 | A * | 9/1997 | Sarver | 280/609 |
| 5,823,562 | A * | 10/1998 | Stubblefield | 280/609 |
| 6,102,428 | A * | 8/2000 | Bobrowicz | 280/607 |
| 6,189,912 | B1 * | 2/2001 | Ritzinger | 280/609 |
| 6,315,317 | B1 * | 11/2001 | Liard et al. | 280/607 |
| 6,382,658 | B1 * | 5/2002 | Stubblefield | 280/609 |
| 6,986,525 | B2 * | 1/2006 | Liard | 280/609 |
| 7,798,514 | B2 * | 9/2010 | Canaday et al. | 280/609 |
| 7,823,892 | B2 * | 11/2010 | Olson et al. | 280/14.22 |
| 8,029,013 | B2 * | 10/2011 | Canaday et al. | 280/609 |
| 2001/0052679 | A1 * | 12/2001 | Stubblefield | 280/14 |
| 2004/0262884 | A1 * | 12/2004 | Langford et al. | 280/601 |
| 2006/0226613 | A1 * | 10/2006 | Wilson | 280/14.22 |
| 2008/0106068 | A1 * | 5/2008 | Drake et al. | 280/601 |
| 2008/0272575 | A1 * | 11/2008 | Olson et al. | 280/609 |
| 2008/0290621 | A1 * | 11/2008 | Vailli | 280/14.21 |
| 2009/0256333 | A1 * | 10/2009 | Canaday et al. | 280/609 |
| 2010/0013191 | A1 * | 1/2010 | McKeever | 280/600 |
| 2011/0079986 | A1 * | 4/2011 | Gradman et al. | 280/609 |

FOREIGN PATENT DOCUMENTS

| | | | | |
|---|---|---|---|---|
| EP | 1935459 | A1 * | 6/2008 | A63C 5/12 |
| FR | 2791268 | A1 | 9/2000 | |
| WO | 9833563 | A2 | 8/1998 | |
| WO | 9910053 | A1 | 3/1999 | |

OTHER PUBLICATIONS

French Search Report; Application No. FR 1050406; Oct. 4, 2010; 2 pages.

* cited by examiner

*Primary Examiner* — Katy M Ebner
*Assistant Examiner* — Hilary L Johns
(74) *Attorney, Agent, or Firm* — St. Onge Steward Johnston & Reens LLC

(57) ABSTRACT

Board for snowboarding, having forward and rear contact lines; binding-mounting areas, forward and rear respectively, each including a set of mounting points by which the binding is secured to the board, each mounting area having a central position; a non-zero camber (C), measured substantially midway between the forward and rear contact lines; wherein, seen from above, the forward and rear contact lines pass through areas, a forward and a rear area respectively, each delimited by two transverse lines, an inner and an outer line respectively, located between the central positions of the binding-mounting areas, the outer transverse line of the forward area being at a distance (D2) of at least 100 mm relative to the central position of the forward binding mount, the outer transverse line of the rear area being at a distance (D4) of at least 120 mm relative to the central position.

11 Claims, 1 Drawing Sheet

BOARD FOR SNOWBOARDING

CROSS-REFERENCE TO RELATED APPLICATIONS

The present application claims priority of pending French patent application No. 10 50406 filed on Jan. 21, 2010, the content of which is incorporated herein by reference.

FIELD OF THE INVENTION

The invention relates to the field of devices used for sliding on snow, and more specifically boards for use in snowboarding. It is related more specifically to a new board architecture with the geometric characteristics thereof being intended to improve maneuverability and control on compacted snow, while facilitating use on powder snow. In the remainder of the description, the different technical terms defining the geometric parameters of the sliding boards will be defined with reference to ISO standard 6289, or else by a specific definition where appropriate.

BACKGROUND OF THE INVENTION

Generally speaking, the boards used in snowboarding have seen their geometry evolve so that they can be adapted for use both on piste, i.e. on compacted snow, and on powder snow. A present-day trend thus comprises using snow boards of shorter length to facilitate on-piste maneuvering. Complementarily, to retain sufficient lift, the boards have been modified in order to broaden them in the front (and rear), i.e. beyond the forward (and rear) contact line. The wider transverse lines to the front and rear can thus be placed on some models beyond the forward and rear contact lines.

A description has been given in the document EP-1 935 459 of a snow board which has such a geometry, wherein the running length, defined between the forward and rear contact lines, is shorter than the distance separating the wider lines. This amounts in practice to offsetting the contact lines by a few centimeters behind the wider lines in such a way that the active sidecut when executing a turn exceeds the running length, thereby allowing the board to be maneuvered more easily when it is flat on the snow.

However, these boards do have one drawback in that they remain overall fairly difficult to maneuver on packed snow, since the significant running length thereof opposes swiveling motions when the board is flat, on compacted snow.

SUMMARY OF THE INVENTION

A problem that the invention therefore proposes to resolve is that of improving board response by facilitating the maneuverability thereof on the basis of properties defined by the intrinsic geometry of the board. The invention thus relates to a board for snowboarding, which has:

- forward and rear contact lines;
- lines of greater width located beyond the forward and rear contact lines respectively;
- binding-mounting areas, forward and rear respectively, each including a set of mounting points by which the binding is secured to the board, each mounting area having a central position;
- a non-zero camber, measured substantially midway between the forward and rear contact lines.

In accordance with the invention, this snowboard is characterized in that, when seen from above, the forward and rear contact lines pass through areas, a forward and a rear area respectively, each delimited by two transverse lines, an inner and an outer line respectively, which are located between the central positions of the binding-mounting areas. To be more specific, the outer transverse line of the forward mounting area is located at a distance of at least 100 mm from the central position of the forward mounting area of the binding, and for the rear mounting area, the outer transverse line is located at a distance of at least 120 mm relative to the central position.

In other words, seen from above, the forward and rear contact lines pass through an area delimited by two transverse lines, forward and rear respectively, located between the central positions of the binding-mounting areas, the forward transverse line being at a distance of at least 100 mm relative to the central position of the forward mounting area of the binding, the rear transverse line being at a distance of at least 120 mm relative to the central position of the rear mounting area of the binding.

Put another way, the board is designed in such a way that the forward and rear contact lines are found substantially between the areas in which the bindings are established. This configuration means that the running length is substantially reduced, which greatly improves board maneuverability, particularly when it is flat on compacted snow. Moreover, the natural camber of the board is modified, namely slightly increased when the user mounts the board. This modification is particularly noteworthy, since it is contrary to what is seen on existing boards, where the space located under the board reduces when the user mounts the board, owing to the fact that the contact lines are located outside, i.e. beyond the positions of the bindings. Conversely therefore, the inventive board sees its camber increase when the board is in use. The presence of the camber allows two distinct grip zones to be maintained. Stability is therefore ensured, despite a large reduction in the running length relative to traditional boards.

In practice, at the level of each binding, the optimum zone for positioning the contact line is between two inner and outer transverse lines, which may be located at distances more or less distant from the central position of the binding-mounting area, as a function of the influence that is required on the camber of the board when in use. This positioning may to advantage differ between the front and the rear, in order to take account of the fact that the setting of the bindings is not symmetrical relative to the middle of the board, and that the bindings may be set back, i.e. moved away relative to the middle of the board. Thus, for the forward binding, the inner transverse line may be located 220 mm, or even 200 mm from the center of the forward binding-mounting area. For the rear binding, this inner transverse line may be located 230 mm or even 210 mm from the center of the rear mounting area. Likewise, on the forward side, the outer transverse line may be 100 mm, 110 mm or 120 mm from the center of the forward binding-mounting area. On the rear side, the outer transverse line may be 120 mm, 130 mm or 140 mm from the center of the rear binding-mounting area. Depending on the type of geometry of the mounting area, and particularly on the capacity thereof to accommodate bindings in multiple adjustment positions, the two transverse lines may be selected in accordance with the aforementioned predetermined locations.

In practice, the central position of the binding-mounting area corresponds to the middle (in the longitudinal direction) of the binding-mounting points, or to the middle of the binding centers between the two extreme positions of the binding. In a widely found type of binding, a mechanism is used for screwing the base plate, or an intermediary such as a disk, onto the board at four points formed by inserts built in when the board is manufactured. These mounting points could also be created after the board is manufactured, at the request of the user. There are also bindings wherein the number of locking points is different, without this departing from the framework of the present invention, in so far as it is possible to determine the center of the mounting area as being at the middle of the binding centers between the two extreme positions of the binding, which can be embodied by markers on the board. Reference may for example be made to the mechanism described in the document FR 2 791 268, according to which the center of the mounting area is in the middle of the rail into which the locking pin is inserted, or again on a dedicated marking.

Furthermore, it is frequently the case that boards are designed so that the bindings can be mounted in a plurality of different positions, so as thereby to allow an adjustment of the "stance", or in other words the width between the feet of the user. This also allows the longitudinal position of the mid-point between the feet to be adjusted. In this case, the board has different inserts which are distributed longitudinally, from which the center of the mounting area can be defined, as being the center of mass of the centers of the mounting points for the different positions that the binding is able to adopt.

The invention thus comprises combining a positioning of the contact lines substantially between the feet of the user with a board turn-up allowing optimized control when executing a turn.

According to another inventive feature, plumb with the centers of the forward and/or rear binding-mounting areas, the running surface of the board is separated from the horizontal plane on which it lies by a distance of between 0.5 and 4 mm, preferentially between 1 and 3 mm, and very preferentially in the vicinity of 2 mm.

Complementarily, at a distance of 50 mm short of the wider lines, the running surface of the board is separated from the horizontal plane on which it lies by a distance of between 3 and 9 mm, preferentially between 4 and 8 mm, and very preferentially between 5 and 7 mm.

These measurements are taken with the board laden at the center, its camber being canceled. It is important to note that at these different points where the height of the running surface is measured, we are beyond the contact line, in the shovel, and not in the camber, unlike with conventional boards.

Indeed, it has been noted that the board turn-up forward from the forward contact line has a significant influence on the maneuverability and control thereof. Thus, when the board is perfectly flat, the portion of the edges in contact with the snow extends between the forward and rear contact lines. On the other hand, it should be noted that this is no longer the case when executing a turn, when the board is no longer lying flat on the snow, or also in soft snow. In this event, the portion of the sidecut which comes into contact with the snow extends beyond the forward and rear contact lines, and theoretically as far as the widest points of the board in the event of an extreme tilt. It has been determined that for the most widely used intermediate tilts, of about 30°, a compromise needs to be made as regards the way in which the board turns up beyond the contact lines. Thus, and according to one of the inventive features, this influence is determined by measuring the height of the board at different longitudinal levels, and in particular plumb with the centers of the binding-mounting areas, as well as at a point located short of the wider lines, and typically at a distance of about 50 mm from said lines.

Thus, the height measured at these points will not have to be too large at the risk of too greatly reducing the length of the sidecut in contact with the snow in the event of a standard tilt. Conversely, this height must be not too low either since otherwise, when starting a turn, and for very small tilts, of about 10°, the sidecut grip points would be very much offset towards the front and the rear relative to the contact lines. Put another way, board maneuverability would be reduced because of the too low height of the characteristic point where the height in question is measured.

The characteristic positioning of the contact lines, substantially between the binding-mounting areas, has the advantage that the intrinsic camber of the board is increased when the board is laden with the user. Indeed, the stresses caused by the weight of the user are applied outside the contact lines, around which the board is deformed under the effect of the weight of the user. The camber with the board laden with the user is slightly more significant than that of the non-laden board, in contrast to conventional boards. It will be noted therefore that the positions of the contact lines according to ISO standard 6289 are measured with a canceled camber, the board being laden at the center, whereas in normal operation, the inventive board is laden with the weight of the user in characteristic zones away from the center of the board, so that the camber is not canceled.

This characteristic positioning of the forward and rear contact lines may also be defined in a relative way as a function of the mid-position of the two binding-mounting areas, and to be more specific of the two centers of said zones. In practice, it is also possible to define the distance between the two contact lines, which corresponds to the running length, and which is 320 mm maximum.

The advantage in relation to the characteristic arrangement of the contact lines may be further enhanced by a complementary arrangement in respect of board thickness. Provision may thus be made to reduce the thickness of the board in a peripheral area.

Said area may extend over the entire periphery of the board, or be limited only to the front and rear portions, with a constant thickness being retained in the waist area as far as the lateral edges.

The reduction in thickness may give the shape of a bevel, with the sliding surface in these peripheral areas which forms a slight non-zero angle (typically of the order of a few degrees) relative to the sliding running surface in the central area thereof.

BRIEF DESCRIPTION OF THE DRAWINGS

The way in which the invention may be embodied, together with the advantages arising therefrom, will become clearer from the description and the following embodiment, supported by the appended figures wherein.

Figure 1:
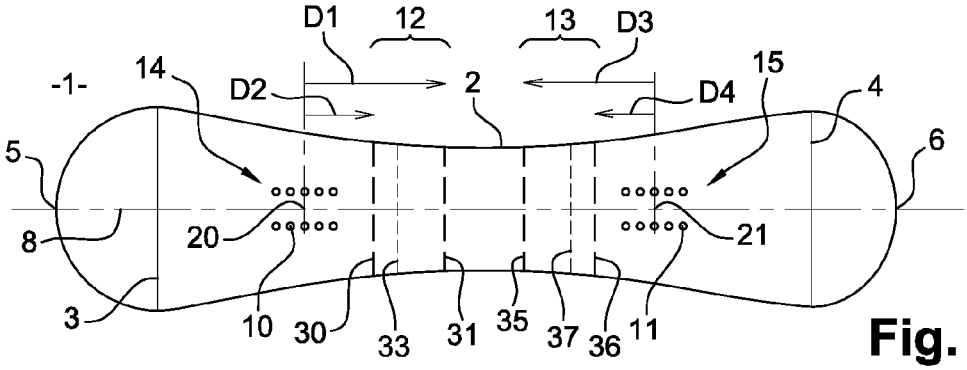
FIG. 1 is a view from above of a snowboarding board in accordance with the invention

Clearly, the dimensions and different proportions featuring on the drawing are given for the main purpose of facilitating understanding of the invention, and may be at variance with the actual dimensions and proportions.

DETAILED DESCRIPTION OF THE INVENTION

Figure 2:
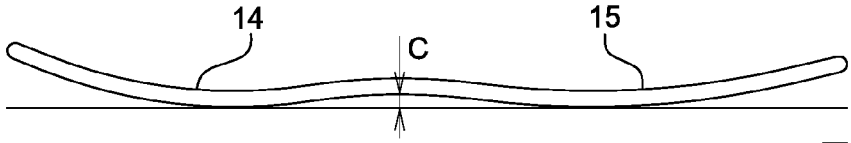
FIG. 2 is a side view of the board in FIG. 1 shown non-laden.

As shown in FIGS. 1 and 2, the sliding board 1 in accordance with the invention has a sidecut 2 whereof the portion coming into contact with the snow is of variable length depending on the tilt of the board relative to the ground surface. Said board 1 has two lines 3 and 4 where it has greater width, which may be identical or different between the front and the rear. These two lines may be at the same distance or at a different distance from the ends 5,6 of forward and rear shovels respectively.

As shown in FIG. 2, the board has when at rest, i.e. non-laden, a camber (C), corresponding to the maximum height which separates the sliding running surface from a horizontal plane on which the board lies, a camber which is measured in practice substantially at mid-length between the two contact lines.

As shown in FIG. 1, the board 1 also comprises two binding-mounting areas 14,15. To be more specific, on each side, front and rear of the board, the board has a plurality of mounting points 10,11 forming a set of a plurality of juxtaposed squares, and thereby defining the same number of possible positions for mounting the binding. This particular geometry is clearly not the only one that is conceivable, and it is possible for the binding zone to be implemented via a set of inserts arranged differently, and particularly in staggered rows, in order to accommodate other types of binding. It is also possible, in a form not shown, to use bindings that are secured to the board not via discrete points, but using a rail mechanism that allows a continuous adjustment of the binding in the longitudinal direction, like the one described in the document FR 2 791 268.

Whatever type of binding and mounting point is used, it is possible to define a central point 20,21 as being the middle or center of symmetry of the different mounting points 10,11 of the binding. This point also corresponds to the intersection of the longitudinal axis of the foot, with the longitudinal axis 8 of the board when the binding is in its median position of longitudinal adjustment.

In accordance with the invention, the forward and rear contact lines of the board are defined so that they are located substantially between the binding-mounting areas, and thereby between the zones where direct pressure is applied by the user. The contact lines are determined with the camber canceled, using a 0.1 mm thick gage. To be more specific, as shown in FIG. 1, a forward characteristic area 12 is defined between two lines 30,31 defined as follows: the line 30, located towards the forward shovel 5, is at a distance D2 from the point 20 of the center of the binding-mounting area. This line 30, directed crosswise relative to the board, defines the most advanced position of the forward contact line 33. On the board center side, the line 31 is defined as being apart by a distance D1 relative to the point 20 constituting the center of the binding-mounting area. In practice, the distance D1 is selected to be between 180 and 220 mm, and the distance D2 between 100 and 115 mm respectively.

According to one inventive feature, the forward contact line 33 is therefore between the two characteristic boundaries 30,31.

The same reasoning applies for the rear binding-mounting area, it being understood that the distances D3, D4 separating the characteristic lines 35,36 from the central point 21 of the rear binding-mounting area, may be identical or preferentially different from those of the forward binding-mounting area.

Figure 4:
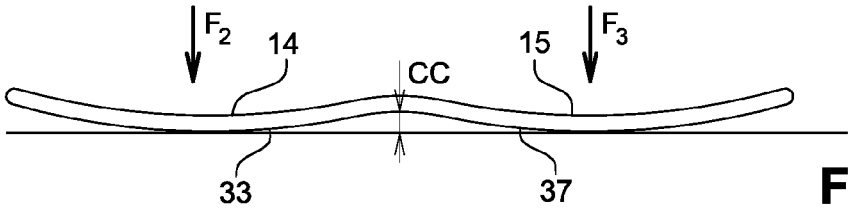
FIG. 4 is a view similar to FIG. 3, but showing the board laden with the weight of a user at the two binding-mounting areas.

As shown in FIG. 2, it may be observed that the board 1 has a camber C, which corresponds to the maximum distance separating the running surface from the horizontal plane on which the board lies without receiving any load. This camber is canceled by applying an appropriate stress F1 at the center of the board. The running surface of the board is then in contact with the horizontal plane over the whole of the bearing surface. This bearing surface is delimited by forward 33 and rear 37 contact lines, which are, according to one inventive feature, positioned between the binding-mounting areas. In this way, and as shown in FIG. 4, when the stresses F2, F3 are applied to the binding-mounting areas, the camber at the center of the board tends to be accentuated until it reaches a value CC greater than that of the camber C when non-laden.

Figure 3:
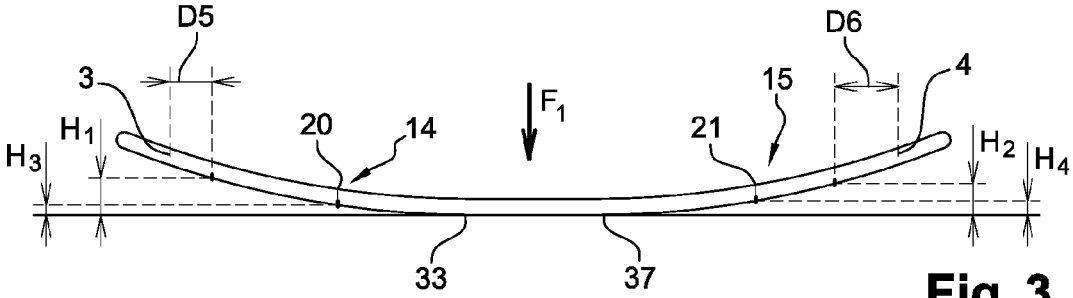
FIG. 3 is a side view of the board in FIG. 1 shown laden at its center.

According to another inventive feature, and as shown in FIG. 3, the board has a gradual turn-up beyond the forward 33 and rear 37 contact lines, which is identified in order to confer an optimized response. To be more specific, at a distance D5 of 50 mm short of the wider line 3, the bottom surface of the board is separated from the horizontal plane on which the board lies, by a distance H1 of between 3 and 9 mm. In practice, this distance is measured when the board is laden at its center and its camber is therefore canceled.

On the rear shovel side of the board, a similar turn-up is measured, at a distance D6, also of 50 mm from the wider line 4. At this point, the bottom surface of the board is at a distance H2 from the horizontal plane on which it lies, said distance H2 being able to be equal to the distance H1 measured on the other side of the board, or once again different.

Complementarily, plumb with the center 20 of the forward binding-mounting area 14, the bottom surface of the board is separated from the horizontal plane on which the board lies, by a distance H3 of between 0.5 and 4 mm. In practice, this distance is measured when the board is laden at its center and its camber is therefore canceled. Symmetrically, at the center 21 of the rear binding-mounting area 15, the bottom surface of the board is separated from the horizontal plane on which the board lies, by a distance H4 which may be equal to or different from H3, and of between 0.5 and 3 mm.

It is clear from what has been said above that the inventive sliding board has a great many advantages, particularly the possibility of being used both on compacted snow and powder snow, with the same ease of use and the same maneuverability.

What is claimed is:

1. A board for snowboarding, having:

forward and rear contact lines;

forward and rear binding-mounting areas, each including a set of mounting points by which a binding is securable to the board, each binding-mounting area having a transverse center line;

wherein the transverse center of the board includes a non-zero camber when the board is non-laden;

wherein, when the center of the board is laden and the camber is cancelled, the forward and rear contact lines pass through forward and rear areas respectively, the forward and rear areas each delimited by an inner and an outer transverse line located between the transverse center lines of the binding-mounting areas, the outer transverse line of the forward area being at a distance of at least 100 mm relative to said transverse center line of the forward binding-mounting area, the outer transverse line of the rear area being at a distance of at least 120 mm relative to said transverse center line of the rear binding-mounting area.

2. The board for snowboarding as claimed in claim 1, wherein the inner transverse line of the forward area is located at a distance of at most 220 mm relative to said transverse center line of the forward mounting area, and the inner transverse line of the rear area being at a distance of at most 230 mm relative to the transverse center line of the rear mounting area.

3. The board for snowboarding as claimed in claim 1, wherein the inner transverse line of the forward area is located at a distance of at most 200 mm from the transverse center line of the forward binding-mounting area, the inner transverse line of the rear area being located at a distance of at most 210 mm from the transverse center line of the rear mounting area.

4. The board for snowboarding as claimed in claim 1, wherein the outer transverse line of the forward area is located at a distance of at least 110 mm from the transverse center line of the forward binding-mounting area, the outer transverse line of the rear area being located at a distance of at least 130 mm from the transverse center line of the rear binding-mounting area.

5. The board for snowboarding as claimed in claim 1, wherein the outer transverse line of the forward area is located at a distance of at least 120 mm from the transverse center line of the forward binding-mounting area, the outer transverse line of the rear area being located at a distance of at least 140 mm from the transverse center line of the rear binding-mounting area.

6. The board for snowboarding as claimed in claim 1, wherein the distance separating the forward and rear contact lines is less than 320 mm.

7. The board for snowboarding as claimed in claim 1, wherein, plumb with the transverse center line of the forward and/or rear binding-mounting area, the running surface of the board is separated from the horizontal plane on which it lies by a distance of between 0.5 and 4 mm.

8. The board for snowboarding as claimed in claim 1, comprising forward and rear lines of greater width than, and located farther from the center of the board than, the forward and rear contact lines respectively, wherein, at a distance of 50 mm behind and forward of the forward and rear lines of greater width than the forward and rear contact lines, the running surface of the board is separated from the horizontal plane on which it lies by a distance of between 3 and 9 mm.

9. The board for snowboarding as claimed in claim 7, wherein, the distance by which the running surface of the board is separated from the horizontal plane on which it lies is between 1 and 3 mm.

10. The board for snowboarding as claimed in claim 8, wherein the distance by which the running surface of the board is separated from the horizontal plane on which it lies is between 4 and 8 mm.

11. The board for snowboarding as claimed in claim 10, wherein the distance by which the running surface of the board is separated from the horizontal plane on which it lies is between 5 and 7 mm.

* * * * *